US007130553B2

(12) United States Patent
Sakai

(10) Patent No.: US 7,130,553 B2
(45) Date of Patent: Oct. 31, 2006

(54) HEATING APPARATUS WITH CONVEYANCE INTERVAL CONTROLLER AND CONTROL OF ELECTRIC POWER IN CONFORMITY WITH DETECTED TEMPERATURE

(75) Inventor: Hiroaki Sakai, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 168 days.

(21) Appl. No.: 10/740,544

(22) Filed: Dec. 22, 2003

(65) Prior Publication Data

US 2004/0131374 A1 Jul. 8, 2004

(30) Foreign Application Priority Data

Dec. 26, 2002 (JP) ..... 2002-377671

(51) Int. Cl.
*G03G 15/20* (2006.01)

(52) U.S. Cl. ..... 399/68; 399/69

(58) Field of Classification Search ..... None
See application file for complete search history.

(56) References Cited

U.S. PATENT DOCUMENTS 5,289,247 A * 2/1994 Takano et al. ..... 399/68
5,552,874 A * 9/1996 Ohtsuka et al. ..... 399/335
5,621,511 A * 4/1997 Nakayama ..... 399/44
5,682,576 A 10/1997 Sakai et al. ..... 399/69
5,819,134 A 10/1998 Sato et al. ..... 399/69
5,904,871 A 5/1999 Sakai et al. ..... 219/216
5,991,563 A * 11/1999 Haneda et al. ..... 399/68
6,791,671 B1 * 9/2004 Hayashi et al. ..... 355/405

FOREIGN PATENT DOCUMENTS

JP 7-114295 5/1995
JP 7-334031 12/1995
JP 08220929 A * 8/1996
JP 8-248810 9/1996
JP 09237013 A * 9/1997
JP 2-727899 3/1998
JP 10-312127 11/1998
JP 11052781 A * 2/1999
JP 2002229381 A * 8/2002

* cited by examiner

*Primary Examiner*—Robert Beatty
(74) *Attorney, Agent, or Firm*—Fitzpatrick, Cella, Harper & Scinto

(57) ABSTRACT

An image forming apparatus having a fixing apparatus for nipping a recording material bearing an unfixed toner image on the surface thereof by a nip portion between a fixing member and a pressure member and fixing the unfixed toner image on the surface of the recording material has a first temperature detecting element and a second temperature detecting element for detecting the temperatures of the fixing member and the pressure member, respectively, and electric power supplied to a heating portion for heating the fixing member is controlled in conformity with the detected temperature by the first temperature detecting element. When image forming on a plurality of recording materials is to be continuously effected, the conveyance interval of the recording materials is controlled so as to become short when the detected temperature of the pressure member is high, and to become long when the detected temperature of the pressure member is low.

1 Claim, 11 Drawing Sheets

HEATING APPARATUS WITH CONVEYANCE INTERVAL CONTROLLER AND CONTROL OF ELECTRIC POWER IN CONFORMITY WITH DETECTED TEMPERATURE

BACKGROUND OF THE INVENTION

1. Field of the Invention

The invention relates to a heating apparatus for heating and pressurizing a recording material bearing an unfixed toner image on the surface thereof.

More particularly, the invention relates to a toner image heating apparatus of a type which heats and fixes an unfixed toner image corresponding to desired image information formed and borne on the surface of a recording material (such as paper, printing paper, a transferring material sheet, an OHP sheet, glossy paper or glossy film) by a direct method or a transferring method by the use of a toner consisting of heat-fusable resin or the like by suitable image forming process means for electrophotography, electrostatic recording, magnetic recording or the like as a permanently fixed image on the surface of the recording material bearing the image, and an image forming apparatus such as a copying machine or a laser beam printer using the same.

2. Related Background Art

Laser beam printers and the like are known as an image forming apparatuses to which an electrophotographic process is applied. FIG. 11 of the accompanying drawings shows an example of the laser beam printers. In FIG. 11, the reference numeral 1 designates a photosensitive drum, the reference numeral 2 denotes an exposing apparatus, the reference numeral 3 designates a developing apparatus, the reference numeral 4 denotes a transferring member, the reference numeral 5 designates a cleaning apparatus, the reference numeral 6 denotes an electrifying member, the reference numeral 7 designates a fixing apparatus as a heating apparatus, the letter C denotes a sheet supplying cassette containing therein transferring materials which are recording materials to be supplied, the reference numeral 8 designates a sheet feeding apparatus, the letter P denotes a conveying path for the transferring materials, and the letter L designates a laser beam applied from the exposing apparatus 2.

In the above-described printer, the exposing apparatus 2 turns on/off and applies the laser beam L conforming to image information to the surface of the photosensitive drum 1 electrified to desired potential by the electrifying member 6, and eliminates charges to thereby form an electrostatic latent image on the photosensitive drum 1.

The developing apparatus 3 is comprised of a developer (hereinafter referred to as the toner), a developing container and a developing sleeve 31. The toner is supplied from the developing sleeve 31 in conformity with the electrostatic latent image, and a toner image is formed on the photosensitive drum 1. Thereafter, the toner image on the photosensitive drum 1 is transferred to the surface of the transferring material as the recording material by the transferring member 4. The unfixed toner image on this transferring material is heated and pressurized by the fixing apparatus 7, whereby it is permanently fixed on the surface of the transferring material, and the transferring material is discharged from the image forming apparatus.

On the other hand, any toner and paper dust or the like residual on the photosensitive drum 1 during the transfer are removed by the cleaning apparatus 5.

The fixing apparatus 7, as shown in FIG. 12 of the accompanying drawings, is provided with a fixing roller 10 and a pressure roller 20, and the fixing roller and the pressure roller are heated by heaters 13-1 and 13-2, respectively, provided therein. The temperature of the fixing roller 10 is detected as the surface temperature of the fixing roller 10 by a temperature detecting element 30-1 such as s thermistor brought into contact with the surface of the fixing roller, and the heater 13-1 is intermittently operated by a temperature control circuit 14-1 for the fixing heater, whereby the above-mentioned surface temperature is controlled to a predetermined temperature. On the other hand, the temperature of the pressure roller 20 is detected as the surface temperature of the pressure roller 20 by a temperature detecting element 30-2 such as a thermistor brought into contact with the surface of the pressure roller, and the heater 13-2 is intermittently operated by a temperature control circuit 14-2 for the pressure heater, whereby the above-mentioned surface temperature is controlled to a predetermined temperature.

In the above-described fixing apparatus, the transferring material T bearing the toner image t thereon is directed to a contact nip portion (fixing nip) N between the fixing roller 10 and the pressure roller 20, and is heated and pressurized by this nip portion, whereby the toner image is fixed on the surface of the transferring material.

When in the laser beam printer provided with such a fixing apparatus, a higher printing speed is contrived to thereby secure a fixing property, electric power is preferentially supplied to the fixing heater (the heater in the fixing roller) side so that the surface temperature of the fixing roller of the fixing apparatus can be maintained constant. Consequently, electric power supplied to the pressure heater (the heater in the pressure roller) side is limited and therefore, it becomes impossible to maintain the surface temperature of the pressure roller at a sufficiently high temperature.

On the other hand, the amount of heat necessary for fixing differs depending on the basis weight of the transferring material, particularly paper, and therefore, a great amount of heat is necessary for paper having a great basis weight of e.g. 128 $g/m^2$ or 199 $g/m^2$ or the like (hereinafter referred to as the thick paper). Also, when paper having unevenness on the surface thereof for the purpose of a sense of high quality or an improved sense of quality (hereinafter referred to as the rough paper) is to be printed, it is difficult for heat to be transferred to the paper and therefore, the secure a sufficient fixing property, it is necessary to set the temperature of the fixing roller or the pressure roller at a high level. Thus, to sufficiently fix an image on the thick paper or the rough paper, the surface temperature of the pressure roller is important and therefore, heretofore a thick paper mode, a rough paper mode or the like has been provided and has been arbitrarily settable by a user. Such a special mode sets the controlled temperature of the fixing roller at a high level or lowers the throughput to thereby set the temperature of the pressure roller at a high level.

However, when copying with the thick paper or the rough paper by a particular mode (particular controlled temperature and throughput), the surface temperature of the pressure roller is governed by differences in the heat capacity and heat transfer efficiency of the paper. That is, not only the fixing property does not become constant between different kinds of paper such as the thick paper and the rough paper, but also unevenness occurs to the curl amount of the paper. Also, if the particular mode is set for paper having a great basis weight or paper of bad heat transfer efficiency, the entire throughput becomes slow, or conversely, if the throughput is set fast to a certain extent in accordance with paper having a relatively small basis weight or paper of relatively good heat transfer efficiency, there will arise the problem that paper like the former cannot be coped with.

SUMMARY OF THE INVENTION

So, the present invention has been made in view of the above-noted points and the object thereof is to provide a fixing apparatus which can secure a stable fixing property even if the use environment or the kind of recording material differs.

An image forming apparatus according to the present invention is an image forming apparatus having a fixing apparatus for nipping a recording material bearing an unfixed toner image on the surface thereof by a nip portion between a fixing member and a pressure member and fixing the unfixed toner image on the surface of the recording material, comprising:

first heating means for heating the fixing member;

a first temperature detecting element for detecting the temperature of the fixing member;

first electric power controlling means for controlling electric power supplied to the first heating means in conformity with the detected temperature by the first temperature detecting element;

a second temperature detecting element for detecting the temperature of the pressure member; and interval controlling means for controlling the conveyance interval of the recording material, wherein when image forming on a plurality of recording materials is to be continuously effected, the interval controlling means can control the conveyance interval of the recording materials so that the conveyance interval of the recording materials may become short when the detected temperature by the second temperature detecting element is high, and that the conveyance interval of the recording materials may become long when the detected temperature by the second temperature detecting element is low.

Another image forming apparatus according to the present invention is an image forming apparatus having a fixing apparatus for nipping a recording material bearing an unfixed toner image on the surface thereof by a nip portion between a fixing member and a pressure member and fixing the unfixed toner image on the surface of the recording material, comprising:

first heating means for heating the fixing member;

a first temperature detecting element for detecting the temperature of the fixing member;

first electric power controlling means for controlling electric power supplied to the first heating means in conformity with the detected temperature by the first temperature detecting element;

second heating means for heating the pressure member;

a second temperature detecting element for detecting the temperature of the pressure member;

second electric power controlling means for controlling electric power supplied to the second heating means in conformity with the detected temperature by the second temperature detecting element, the electric power being preferentially supplied to the first heating means, and the electric power supplied to the second heating means being limitable; and interval controlling means for controlling, when image forming on a plurality of recording materials is to be continuously effected, the conveyance interval of the recording materials in conformity with the detected temperature by the second temperature detecting element.

Preferably, the first heating means has a plurality of heating elements.

Preferably, when image forming on the plurality of recording materials is to be continuously effected, the interval controlling means controls the conveyance interval of the recording materials so that the conveyance interval of the recording materials may become short when the detected temperature of the pressure member is high and that the conveyance interval of the recording materials may become long when the detected temperature of the pressure member is low.

According to the present invention, the conveyance interval of the recording materials is controlled so as to become short when the detected temperature of the pressure member is high, and to become long when the detected temperature of the pressure member is low and therefore, the temperature of the pressure member can be maintained substantially within a predetermined range. Thereby, a stable fixing property can be secured even when the use environment or the kind of the recording material differs, for example, when recording materials having a great basis weight are continuously heated and pressurized, or when recording materials are continuously heated and pressurized under low temperature environment.

DETAILED DESCRIPTION OF THE PREFERRED EMBODIMENT (First Embodiment)

Figure 1:
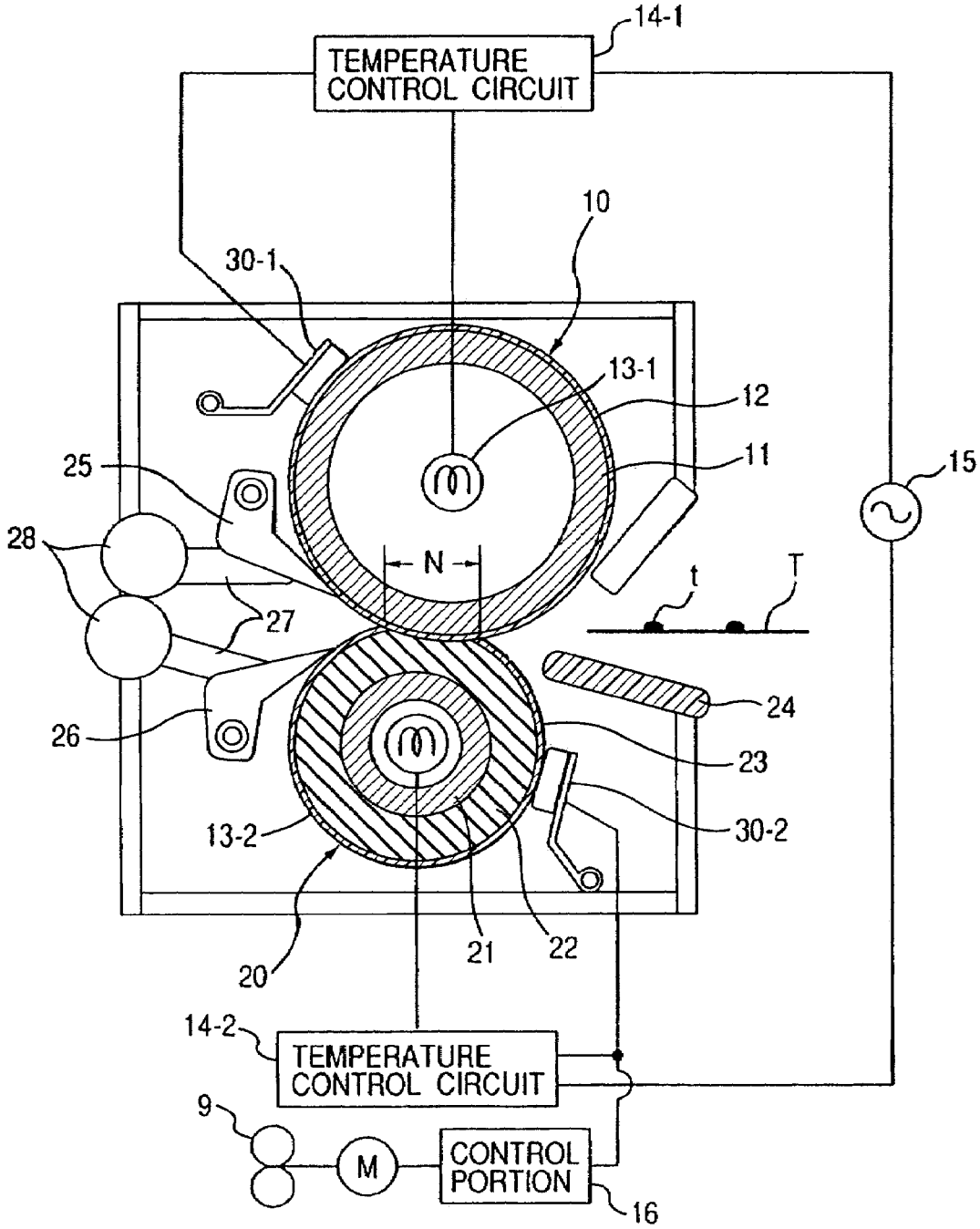
FIG. 1 is a cross-sectional view schematically showing the construction of a fixing apparatus according to a first embodiment of the present invention.

FIG. 1 is a cross-sectional view schematically showing the construction of a heating apparatus according to a first embodiment of the present invention. This heating apparatus (hereinafter referred to as the fixing apparatus) is an example of the center reference for which a transferring material (recording material having an A3 (297 mm) width as a maximum sheet supply size is conveyed with the center of sheet supply of the apparatus as the reference.

In FIG. 1, the reference numeral 10 designates a fixing roller comprising, for example, a mandrel 11 of aluminum, iron or the like and a mold-releasable resin layer 12 of PFA, PITE or the like provided thereon, and having the interior thereof adapted to be heated by a heater 13-1. The fixing roller 10 shown in the present embodiment is a roller comprising, for example, a mandrel 11 of aluminum and having a diameter of 50 mm and a thickness of 3.0 mm, and has its surface covered with a mold-releasable layer 12 of PFA. The temperature of the fixing roller 10 is detected as the surface temperature of this fixing roller 10 by a temperature detecting element 30-1 (hereinafter referred to as the thermistor) brought into contact with the fixing roller 10, and on the basis of the detected temperature, the heater 13-1 is intermittently operated (ON (energized) and OFF (deenergized)) by a temperature control circuit 14-1 for the fixing heater, and electric power is applied from a commercially available electric power source 15 to the heater 13-1 through the temperature control circuit, whereby the surface temperature of the fixing roller 10 is controlled to a predetermined temperature.

The reference numeral 20 denotes a pressure roller brought into pressure contact and rotated with the fixing roller 10, and comprises, for example, a metal mandrel 21 of aluminum, iron or the like and an elastic layer 22 of silicone rubber or silicone sponge having heat resistance and low in hardness and provided on the metal mandrel 21, and having on the surface thereof a covering layer 23 of resin having high mold releasability such as PFA or PITE, and is adapted to be heated by a heater 13-2 therein. The pressure roller 20 shown in the present embodiment has, for example, an elastic layer 22 of silicone rubber on an aluminum mandrel 21 having a thickness of 5.0 mm, and a mold-releasable layer 23 of PFA on the surface thereof, and has a diameter of 40 mm and product hardness of 63° (Asker-C/1 kg load), and a pressure force of 600 N is applied thereto by the use of a suitable pressure mechanism, whereby a nip width of 7.0 mm can be formed between the pressure roller and the fixing roller. The temperature of the pressure roller 20 is detected as the surface temperature of this pressure roller 20 by a thermistor 30-2 brought into contact with the pressure roller 20, and on the basis of the detected temperature, the heater 13-2 is intermittently operated (ON (energized) and OFF (deenergized)) by a temperature control circuit 14-2 for the pressure heater, and electric power is applied from the commercially available power source 15 to the heater 13-2 through the temperature control circuit, whereby the surface temperature of the pressure roller 20 is controlled to a predetermined temperature. Also, the surface temperature of the pressure roller detected by the thermistor 13-2 is inputted to a control portion 16 comprising a microprocessor provided with a CPU and a memory such as a ROM or a RAM. The memory stores therein a sheet interval adjustment temperature control table, a sheet interval adjustment temperature control processing program, etc. for adjusting the sheet interval of the transferring material T (the interval between the transferring materials when the transferring materials are continuously printed) in conformity with the detected temperature by the thermistor 13-2, and the CPU controls the driving of the pair of registration rollers 9, etc. of a laser beam printer which will be described later in accordance with the above-mentioned program when a sheet interval adjustment mode, not shown, provided in the printer is selected.

As the heater 13-1 and the heater 13-2, use is made of ones which produce an output of 1000 W when 100 V is inputted thereto, and the light distribution of the heaters is a distribution symmetrical with respect to the sheet supply reference. The thermistors 30-1 and 30-2 are installed on the lengthwisely substantially central portions of the fixing roller 10 and the pressure roller 20, respectively.

In the fixing apparatus shown in the present embodiment, the surface of the fixing roller is temperature-controlled to 190° C. by the temperature control circuit 14-1, whereby with a process speed of 233.3 mm/sec. and a sheet interval of 70 mm, maximum throughput of 50 ppm is realized for A4 landscape.

In the above-described fixing apparatus, the transferring material T bearing an unfixed toner image on the surface thereof is directed to the contact nip portion (fixing nip) N between the fixing roller 10 and the pressure roller 20 by an entrance guide 24, and is heated and pressurized in this nip portion, whereby the toner image is fixed on the surface of the transferring material. The entrance guide 24 is made of a resistance control material (of $10^8$ Ω to $10^{10}$ Ω) such as PBT, or has its guide surface formed of a metal such as stainless steel, and it is practiced to use the aforementioned resistance control material at the point of contact thereof with a fixing frame. This is because when the entrance guide is formed of an insulating material or the like, the guide surface thereof is electrified by the friction thereof with the transferring material and a problem such as the scattering of the toner arises. Also, it is practiced to form a proper inverted crown shape in the lengthwise direction of the fixing roller 10 and the pressure roller 20 so that the transferring material T may not be wrinkled when it passes through the nip portion, and to make the entry portion into the fixing nip proper by the entrance guide 24.

The transferring material T heated and pressurized at the fixing nip N to thereby have had the toner image fixed thereon is separated from one of the two rollers by a fixing roller separation pawl 25 or a pressure roller separation pawl 26, and is directed to sheet discharging rollers 28 by a sheet discharge guide 27 and is discharged out of the apparatus.

Figure 2:
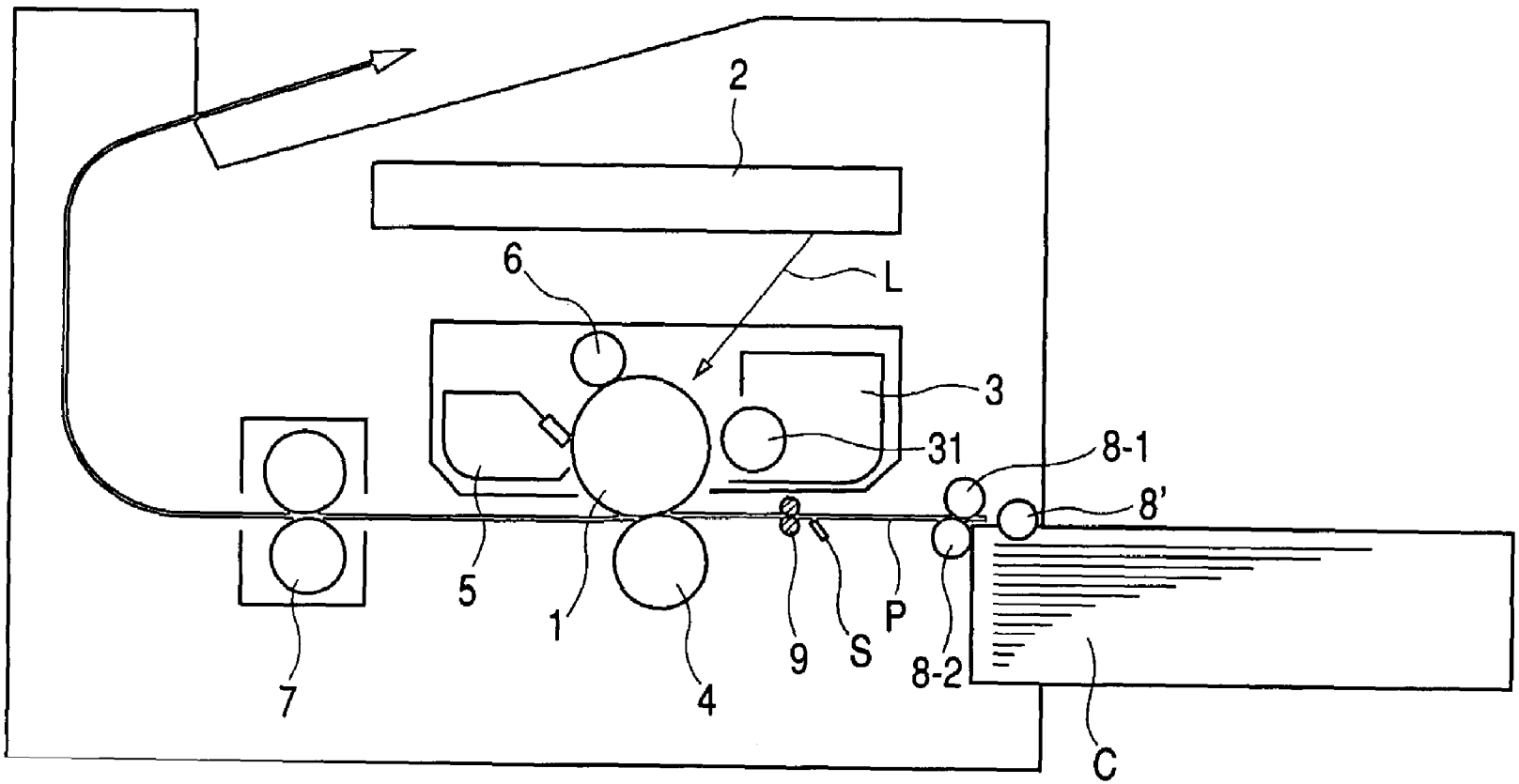
FIG. 2 schematically shows the construction of a laser beam printer carrying thereon the fixing apparatus according to the first embodiment.
Figure 11:
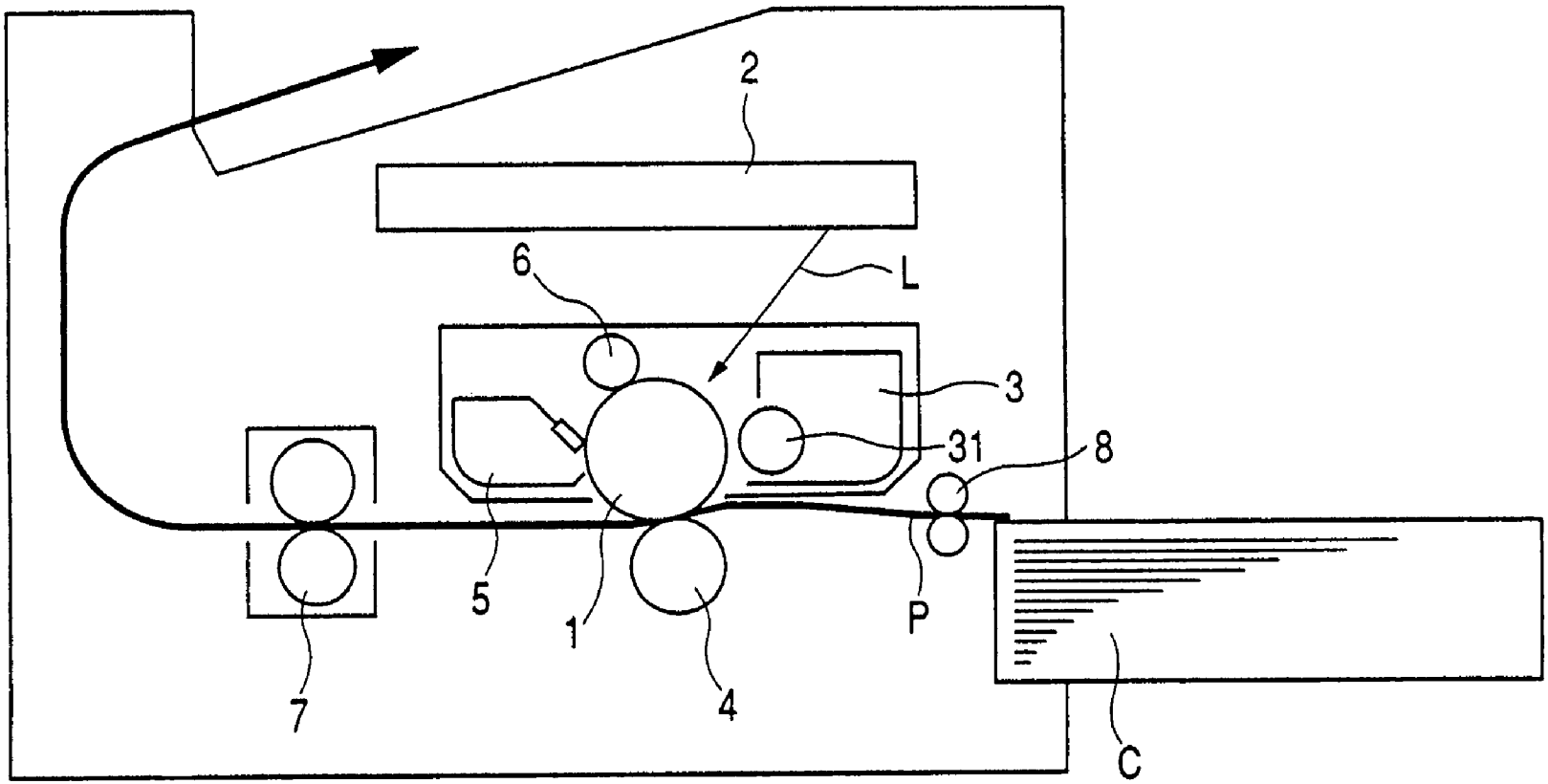
FIG. 11 PRIOR ART
FIG. 11 schematically shows the construction of a conventional laser beam printer.
Figure 12:
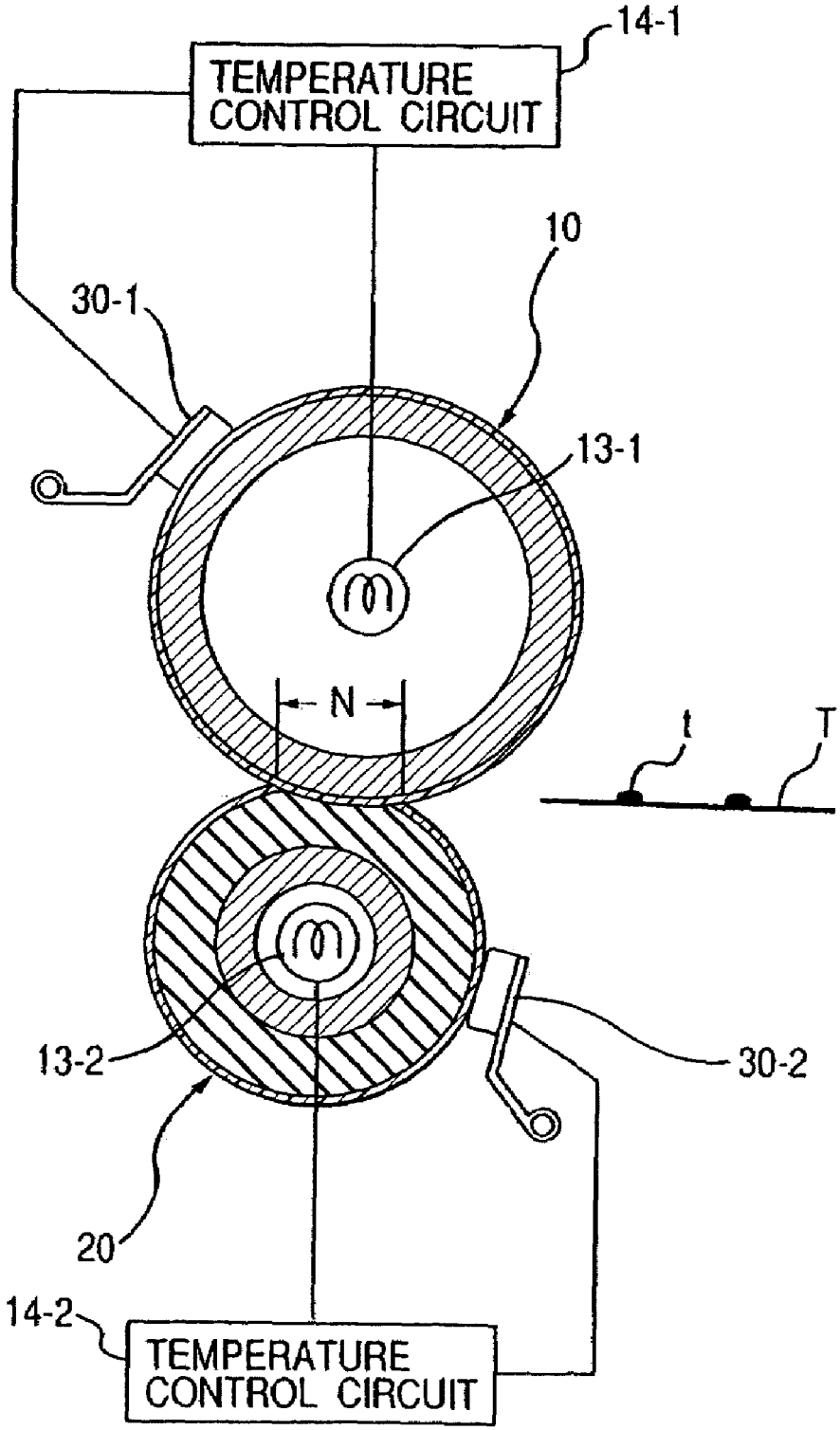
FIG. 12 PRIOR ART
FIG. 12 schematically shows the construction of a conventional fixing apparatus.

FIG. 2 schematically shows the construction of a laser beam printer (image forming apparatus) carrying thereon the fixing apparatus shown in the present embodiment. The sheet feeding operation of this printer will hereinafter be described with reference to FIG. 2. In the laser beam printer shown in FIG. 2, the other chief apparatus construction than the fixing apparatus is similar to that of the conventional example of FIG. 11 and therefore need not be described. In the laser beam printer shown in FIG. 2, a transferring material T is taken out of a cassette C by a pickup roller 8', and in order to prevent double feeding, only one sheet is conveyed by a feed roller 8-1 and a retard roller 8-2. The transferring material T is made to stand by the pair of registration rollers 9 before image forming, and whether it is standing by is detected by a sensor S. When a photosensitive drum 1 becomes ready for image forming, image forming is started in synchronism with vertical synchronizing (VSYNC) signal and the pair of registration rollers 9 convey the transferring material T to a transferring portion.

Figure 3:
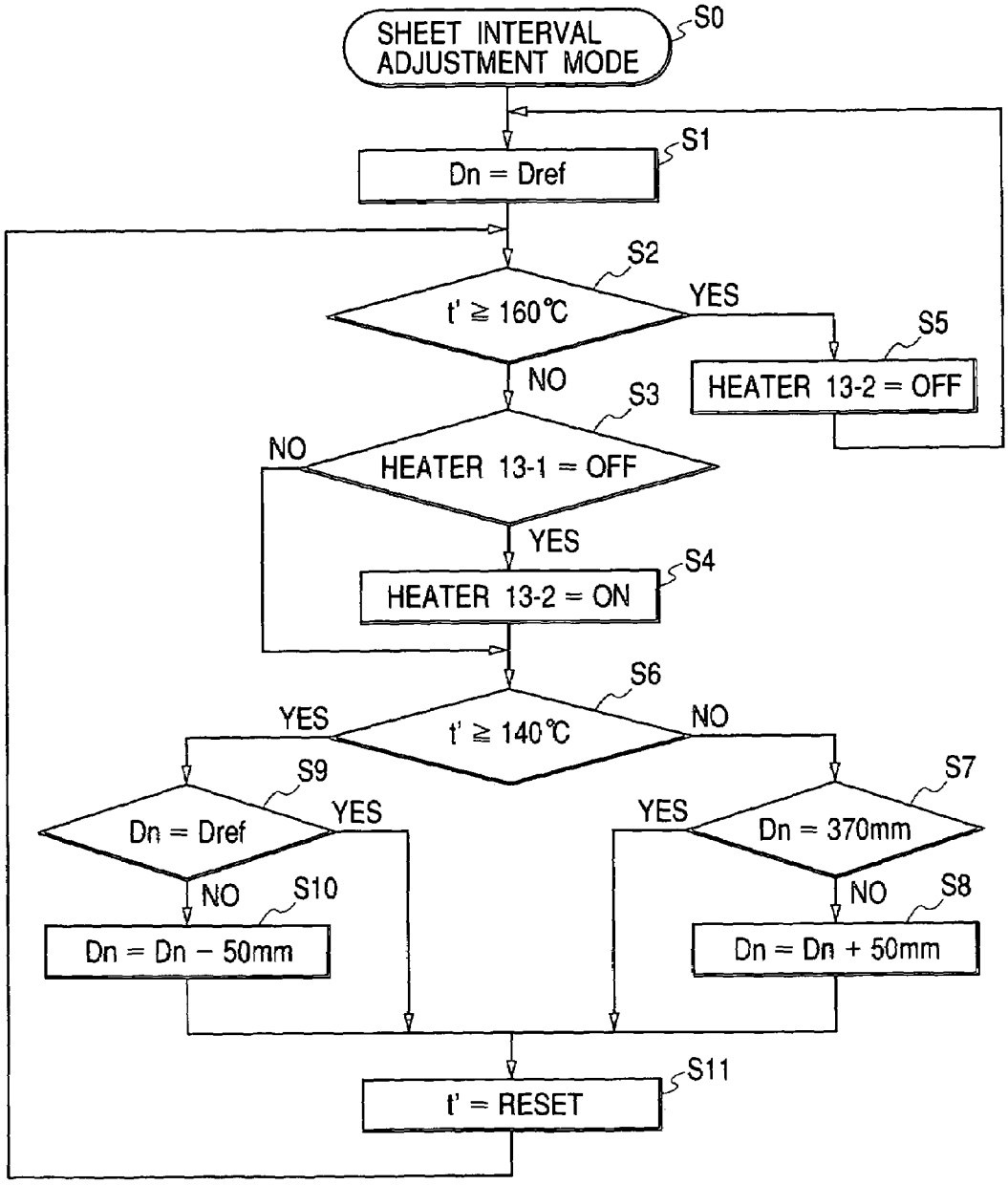
FIG. 3 is a flow chart of heater driving and sheet interval adjustment temperature control executed in the fixing apparatus according to the first embodiment.

FIG. 3 is a flow chart of heater driving executed by the temperature control circuits 14-1 and 14-2 and sheet interval adjustment temperature control executed by the control portion 16. In the present embodiment, a method when the surface temperature of the pressure roller 20 is set to a value of 120° C. to 160° C. as a value at which the fixing property of rough paper which is the transferring material T can be sufficiently secured is shown below.

In FIG. 3, in a case where a user has selected a sheet interval adjustment mode (S0), when printing is started, the sheet interval Dn is set to Dref (default value)=70 mm. The heater 13-1 is driven by the temperature control circuit 14-1 so that the surface temperature of the fixing roller 10 detected by the thermistor 30-1 may be 190° C. The fixing heater 13-1 is driven independently of the pressure heater 13-2, and uses a controlling method similar to that in the conventional control example and therefore need not be described.

In the control portion, if the surface temperature t' of the pressure roller detected by the thermistor 30-2 is less than 160° C. (NO at S2), advance is made to S3, and if the fixing heater 13-1 is OFF (YES at S3), advance is made to S4, where the pressure heater 13-2 is turned on (ON), and the pressure heater 13-2 is driven so that the surface temperature of the pressure roller 20 may become 160° C. If the surface temperature of the pressure roller 20 is 160° C. or higher (YES at S2), advance is made to S5, where the pressure heater 13-2 is rendered OFF, and continuous printing is continued with the sheet interval remaining Dref. As described above, electric power is preferentially supplied to the fixing heater (the heater in the fixing roller) side so that the surface temperature of the fixing roller of the fixing apparatus can be maintained constant, and electric power supplied to the pressure heater (the heater in the pressure roller) side is limited and therefore, it sometimes becomes impossible to maintain the surface temperature of the pressure roller at 160° C.

A sheet interval adjusting method will now be described. In the present embodiment, as shown in Table 1 below, the sheet interval Dn is set to seven steps (0 to 6) at intervals of 50 mm, and a maximum sheet interval is 370 mm. During continuous printing, the next conveyance timing for the paper (transferring material) standing by at the pair of registration rollers 9 follows the following control. First, the surface temperature t' of the pressure roller is measured on the basis of the detected temperature by the thermistor 30-2.

If the surface temperature t' is less than 140° C. (NO at S6), the control of widening the sheet interval is effected. For example, if the sheet interval at the last time is not the maximum value (370 mm)(NO at S7), the sheet interval is made greater by 50 mm than the sheet interval at the last time (S8). Conversely, when t' is 140° C. or higher (YES at S6), if the sheet interval at the last time is not a default value (Dref=70 mm)(NO at S9), the sheet interval is shortened by 50 mm (S10). After the sheet interval has been changed, the minimum temperature t' of the pressure roller is reset (S11) and return is made to S2, and the control of (S2)–(S11) is repeated. It is to be understood here that the measurement of t' is effected at timing whereat continuous printing is possible at Dref=70 mm.

TABLE 1

| Step | Dn [mm] | Throughput [ppm] |
|---|---|---|
| 0 | 70 | 50.0 |
| 1 | 120 | 42.4 |
| 2 | 170 | 36.8 |
| 3 | 220 | 32.6 |

TABLE 1-continued

| Step | Dn [mm] | Throughput [ppm] |
|---|---|---|
| 4 | 270 | 29.2 |
| 5 | 320 | 26.4 |
| 6 | 370 | 24.1 |

Figure 4:
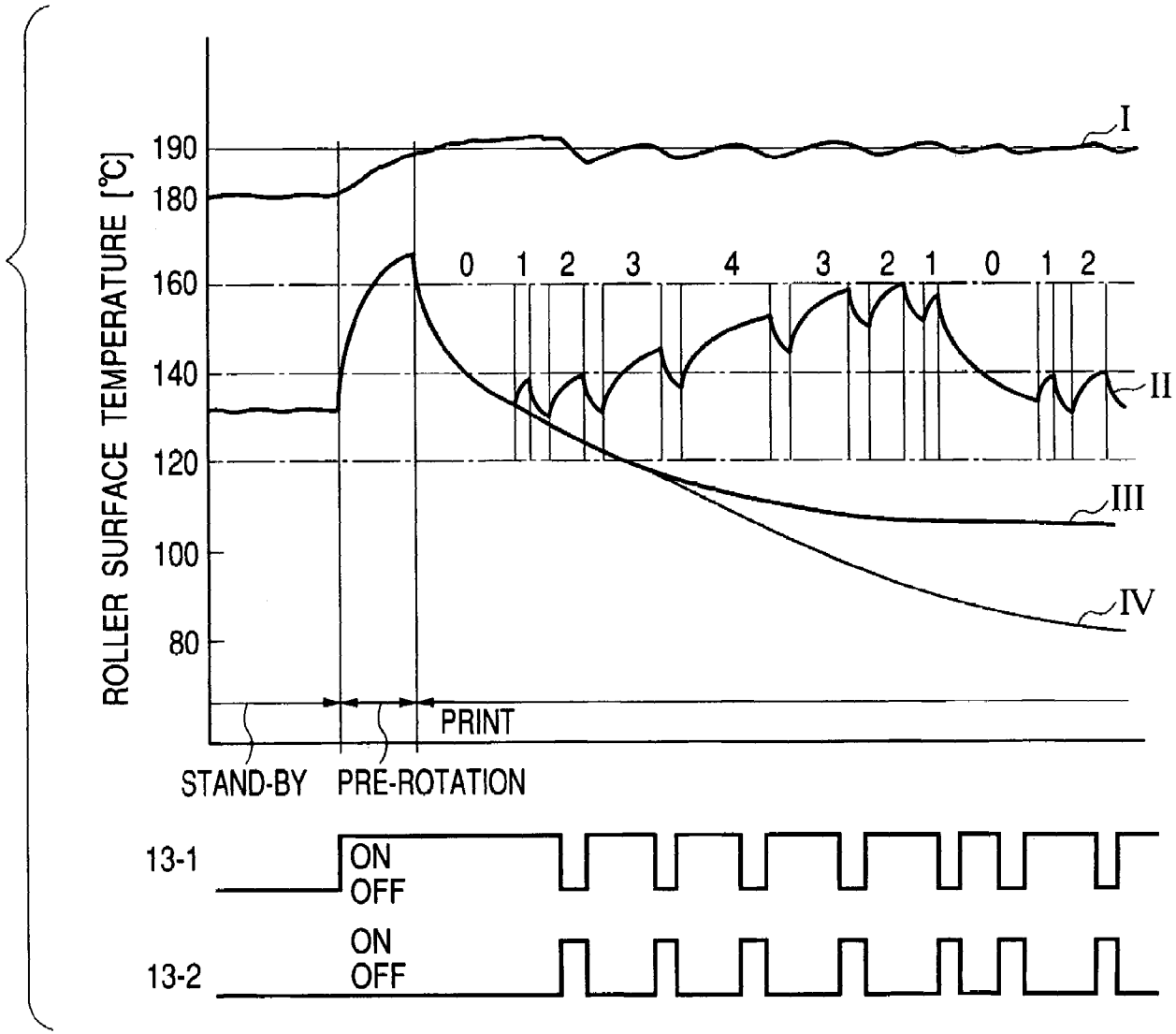
FIG. 4 is a graph showing the relations among the surface temperatures of a fixing roller and a pressure roller, the turned-on state of a heater and the sheet interval in the fixing apparatus according to the first embodiment.

FIG. 4 shows the relations between the surface temperatures of the fixing and pressure rollers and the sheet interval when paper of A4 size having basis weight of 128 g/m$^2$ was continuously printed. In FIG. 4, I indicates the surface temperature of the fixing roller, and shows that the surface temperature is maintained at 190° C. during printing. II indicates the surface temperature of the pressure roller, and shows the relation between the sheet intervals (expressed by numerals corresponding to the steps in Table 1) and the surface temperature of the pressure roller when the sheet interval adjustment of the present embodiment was effected when the surface temperature was below 140° C. As shown in FIG. 4, the recovery situation of the surface temperature of the pressure roller differs in conformity with the sheet intervals at the steps (0, 1, 2, . . . , 6) shown in Table 1 and therefore, by adjusting the length of the sheet interval, it is possible to maintain the surface of the pressure roller within a range of 120° C. to 160° C. This range can be arbitrarily changed depending on the heat transferring capability of the fixing apparatus and the process speed. In the present embodiment, the surface temperature of about 140° C. of the pressure roller is adopted as a temperature at which a sufficient fixing property can be secured and also, when that temperature is exceeded, the sheet interval is set to a small value to thereby maintain high productivity. III indicates the changes in the surface temperature of the pressure roller when continuous printing was done under the same condition, and IV indicates the changes in the surface temperature of the pressure roller when the pressure heater was rendered OFF.

In the fixing apparatus shown in the present embodiment, when paper of basis weight greater than usual is continuously printed or was continuously printed under a low temperature environment, the temperature of the pressure roller 20 can be brought into a constant range even if consumed electric power is increased, and it becomes possible to realize the greatest printing speed under a given environment without reducing the fixing property. Also, in the case of paper such as the rough paper in which it is difficult to transfer heat, it is difficult for the surface temperature of the pressure roller 20 to lower and therefore, it becomes possible to secure a good fixing property at a higher throughput than in the case of the thick paper.

Here, while the sheet interval adjustment mode has been described as being set by the user, it may be set by a print driver or may be directly set from the main body panel of the laser beam printer. It is also possible to enable the paper cassette C or other paper feeding means to set the sheet interval adjustment mode to thereby automatically print in the sheet interval adjustment mode when the user has selected the paper.

Regarding the sheet feeding operation of the laser beam printer, an example of application when image forming is effected with the synchronization of the VSYNC signal taken by the pairs of registration rollers 9 has been shown, but the sheet feeding timing from the paper cassette C may be changed to thereby adjust the sheet interval. At this time, it is possible to install a TOP sensor for detecting the leading edge of paper on this side of the transferring portion to thereby take synchronism between image forming and the paper.

Also, when the user has selected the sheet interval adjustment mode by mistake, that is, even if the user selects the sheet interval adjustment mode when thin paper is to be printed, it is possible to print at an ordinary sheet interval unless the surface temperature of the pressure roller 20 lowers.

(Second Embodiment)

Figure 5:
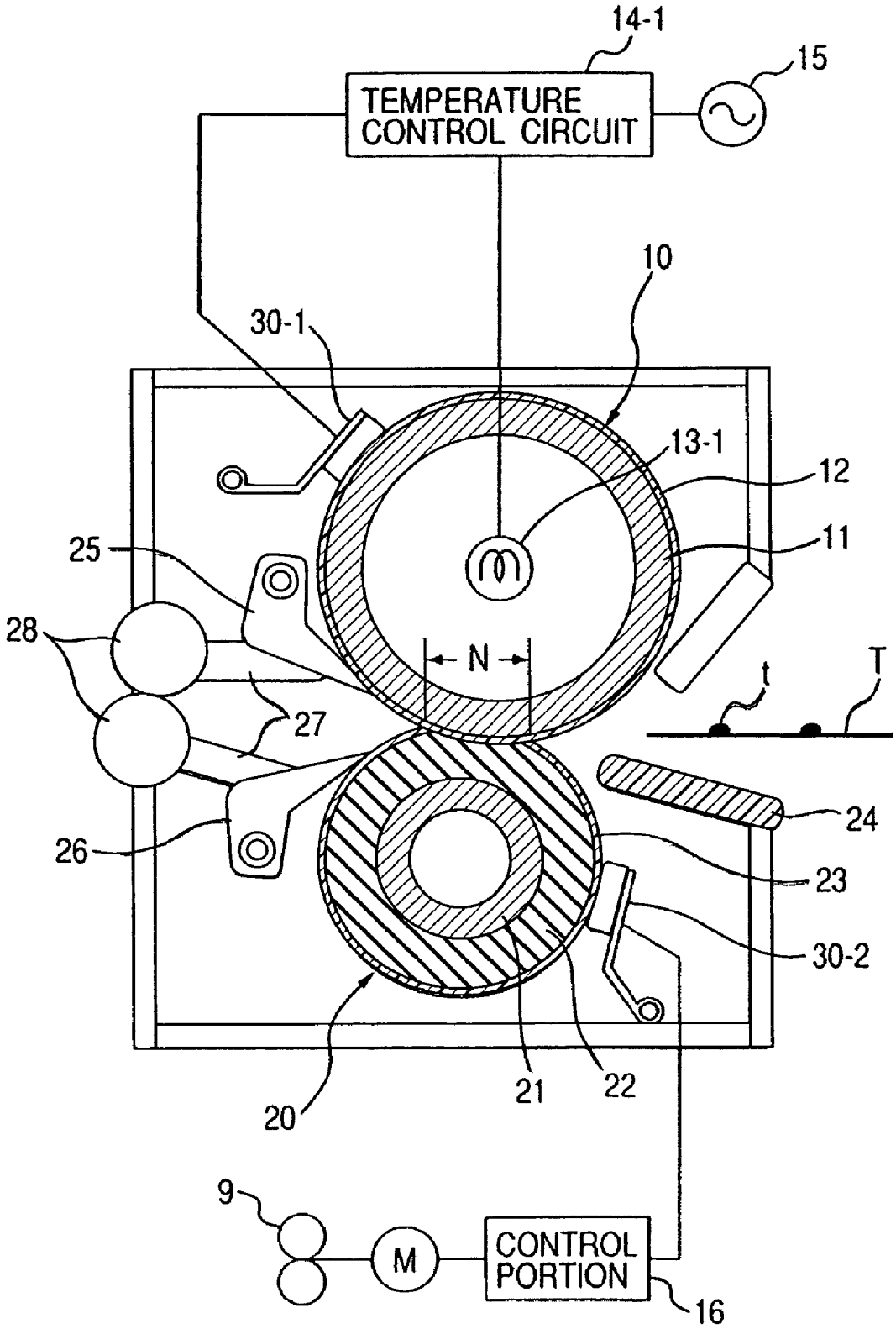
FIG. 5 is a cross-sectional view schematically showing the construction of a fixing apparatus according to a second embodiment of the present invention.

A heating apparatus according to a second embodiment of the present invention will now be described. While in the first embodiment, there has been shown the fixing apparatus carried on a high-speed laser beam printer which can print 50 sheets of A4-size paper per minute, in the present embodiment, there is shown a fixing apparatus carried, for example, on a medium-speed laser beam printer which can print 30 sheets of A4-size paper (transferring material) per minute. FIG. 5 schematically shows the construction of the fixing apparatus according to the present embodiment. The fixing apparatus according to the present embodiment is similar in construction to the fixing apparatus shown in FIG. 1 except for the exclusion of the heater 13-2 from the pressure roller 20.

This fixing apparatus is an example of the center reference in which transferring materials having the A3 (297 mm) width as the maximum sheet supply size are conveyed with the center of sheet supply of the apparatus as the reference, and as the heater 13, use is made of one which produces an output of 1000 W when 100 V is inputted, and the light distribution of the heater is a distribution symmetrical with respect to the sheet supply reference. The fixing roller 10 is a roller comprising an aluminum mandrel 11 and having a diameter of 40 mm and a thickness of 2.0 mm, and has its surface covered with a mold-releasable layer 12 of PFA. As the pressure roller 20, use is made of one having an elastic layer 22 of silicone rubber on an aluminum mandrel 21 having a thickness 5.0 mm, and having a mold-releasable layer 23 of PFA on the surface thereof, and having a diameter of 30 mm and product hardness of 58° (Asker-C/1 kg load), and by a pressure force of 300 N being applied thereto, a nip width of 5.5 mm can be formed between it and the fixing roller. The temperature detecting elements 30-1 and 30-2 are installed substantially on the central portions of the fixing roller and the pressure roller, respectively. In the present embodiment, the surface of the fixing roller is temperature-controlled to 190° C., whereby with a process speed of 135 mm/sec. and a sheet interval of 60 mm, maximum throughput of 30 ppm is realized for A4 landscape. The epitome of the laser beam printer (image forming apparatus is similar to that of the first embodiment and therefore need not be described.

Figure 6:
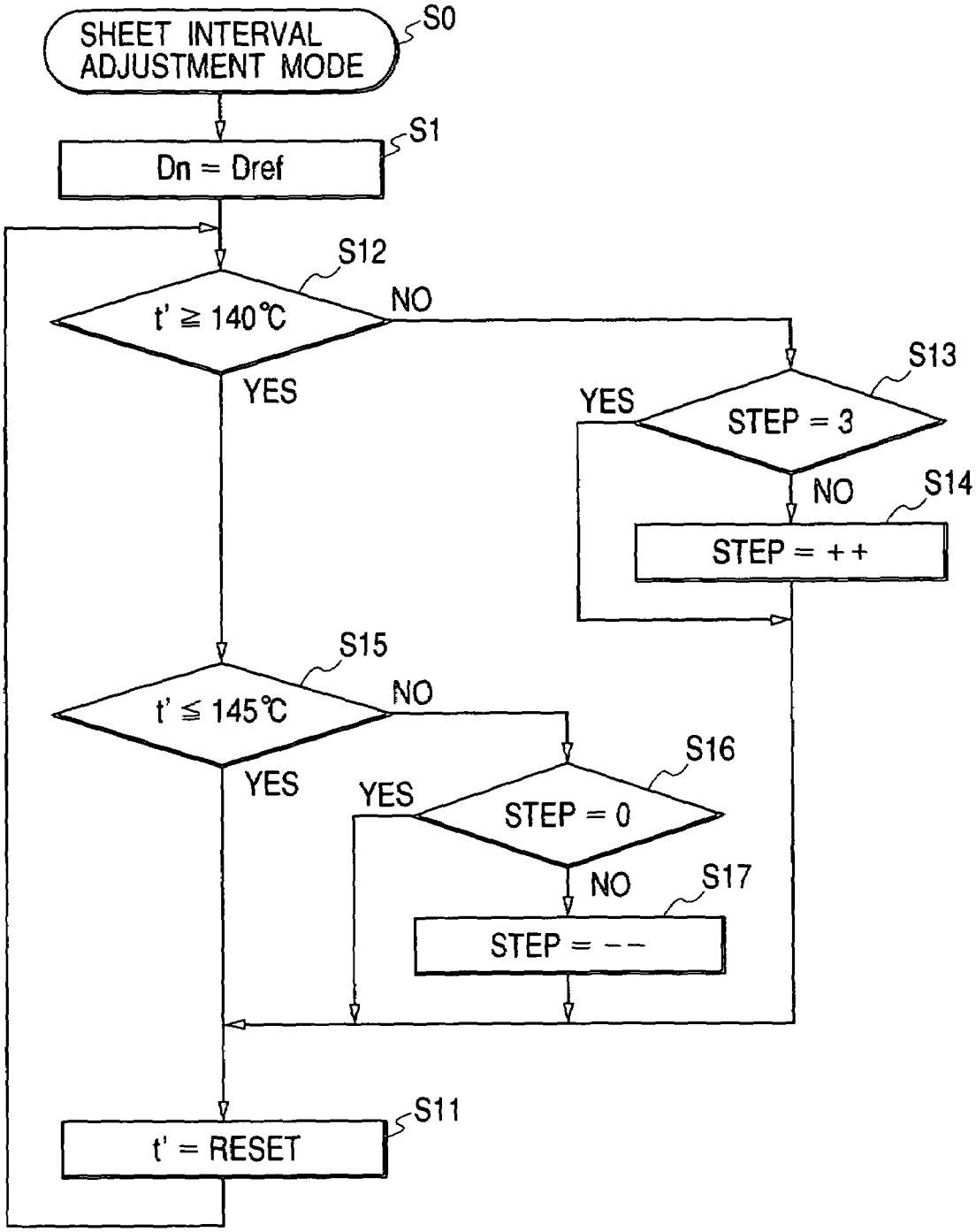
FIG. 6 is a flow chart of heater driving and sheet interval adjustment temperature control executed in the fixing apparatus according to the second embodiment.

FIG. 6 is a flow chart of heater driving executed by the temperature control circuit 14-1 in the fixing apparatus according to the present embodiment, and sheet interval adjustment temperature control executed by the control portion 16. Again in the present embodiment, the method when the surface temperature of the pressure roller 20 is set to a value of 120° C. to 160° C. as a value at which the fixing property of the rough paper can be sufficiently secured is shown below.

In FIG. 6, in a case where the user has selected the sheet interval adjustment mode (S0), when printing is started, the sheet interval Dn is set to Dref=60 mm (S1). The heater 13-1 is driven so that the surface temperature of the fixing roller 10 detected by the thermistor 30-1 may be 190° C. The fixing heater 30-1 uses a controlling method similar to that in the conventional example and therefore need not be described.

Since in the fixing apparatus according to the present embodiment, the pressure roller 20 has no heater therein, (S2) to (S5) of the first embodiment shown in FIG. 3 are omitted.

The sheet interval adjusting method will now be described. In the present embodiment, the pressure roller is provided with no heater and therefore, the change range of the sheet interval is set to a little over a round (94.2 mm) of the pressure roller, and the number of steps changed is set to a small number, i.e., four steps. Here, the range of the sheet interval changed is irregular and therefore, a sheet interval Dn corresponding to each step is set by a look-up table (sheet interval adjustment temperature control table) as shown in Table 2 below. Also, in the present embodiment, control is effected with a hysteresis given to a reference temperature at which the sheet interval is changed, and the sheet interval is controlled so as to be increased at less than 140° C., and to be decreased when the temperature is higher than 145° C.

During continuous printing, the next conveyance timing of the paper standing by at the pair of registration rollers 9 follows the following control. First, the surface temperature t' of the pressure roller is detected. If the surface temperature t' is less than 140° C. (NO at S12), the control of widening the length of the sheet interval is effected. If the sheet interval at the last time is not a maximum value (step=3)(NO at S13), the sheet interval is made greater than the sheet interval at the last time (S14). Conversely, if t' is higher than 145° C. (NO at S15), if the sheet interval is not a default value (Step=0)(NO at S16), the sheet interval is shortened (S17). After the sheet interval has been changed, the minimum temperature t' of the pressure roller is reset (S11) and return is made to (S12), and the control of (S12)–(S11) is repeated. It is to be understood here that the measurement of t' is effected at timing whereat continuous printing is possible at Dref=60 mm.

TABLE 2

| Step | Dn [mm] | Throughput [ppm] |
|---|---|---|
| 0 | 60 | 30.0 |
| 1 | 100 | 26.1 |
| 2 | 200 | 19.8 |
| 3 | 300 | 15.9 |

Figure 7:
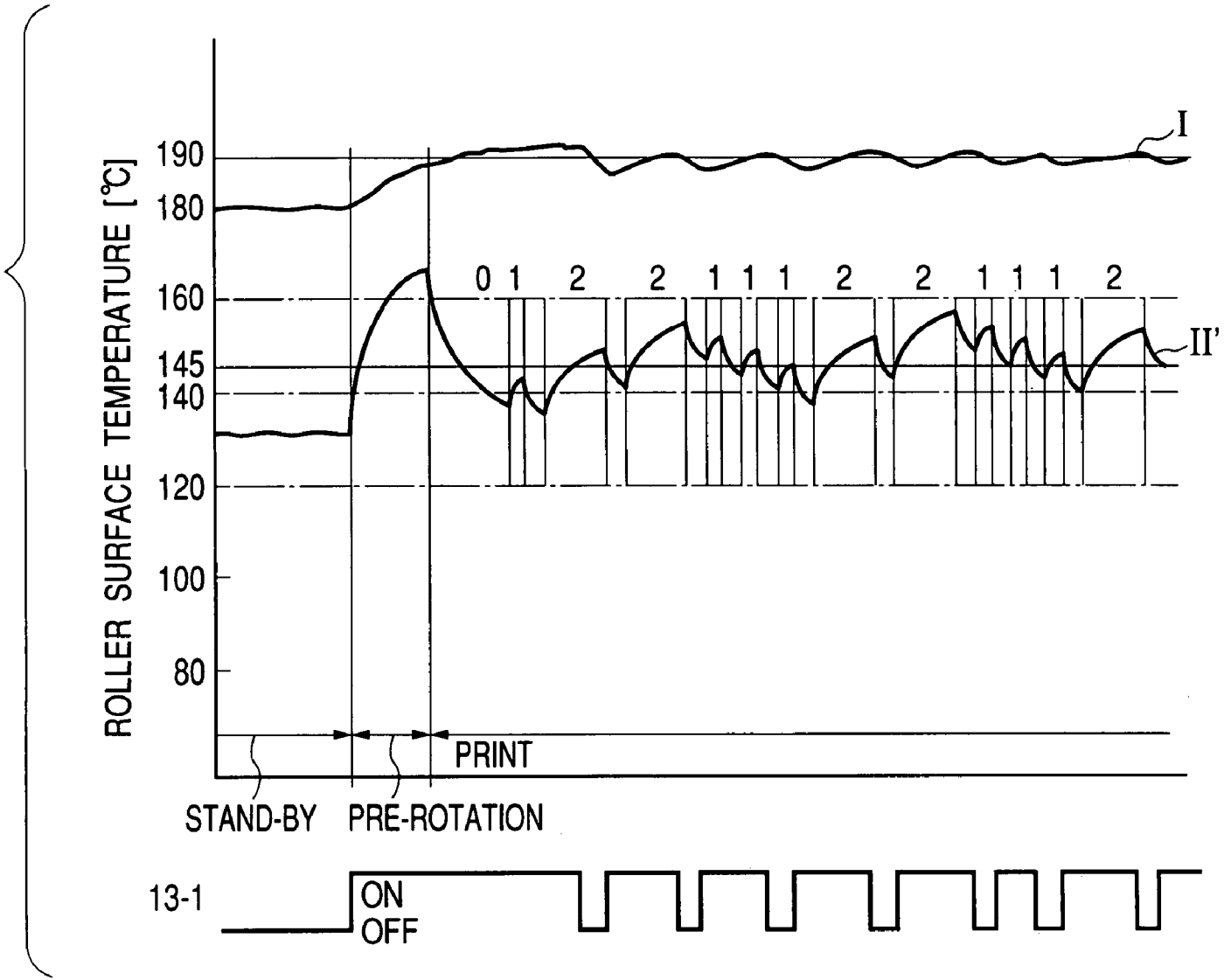
FIG. 7 is a graph showing the relations among the surface temperatures of the fixing roller and the pressure roller in FIG. 2, the turned-on state of a heater and the sheet interval in the fixing apparatus according to the second embodiment.

FIG. 7 shows the relations between the surface temperatures of the fixing and pressure rollers and the sheet interval when paper of A4 size having basis weight of 128 g/m$^2$ was continuously printed. I indicates the surface temperature of the fixing roller, and shows that it is maintained at 190° C. during printing. II' indicates the surface temperature of the pressure roller, and shows the relation between the sheet intervals (expressed by numerals corresponding to the steps in Table 2) and the surface temperature when the sheet interval adjustment of the present embodiment was effected when the surface temperature was below 140° C. The recovery situation of the surface temperature of the pressure roller differs in conformity with the sheet intervals at the steps (0, 1, . . . , 3) shown in Table 2 and therefore, by the length of the sheet interval being adjusted, the surface of the pressure roller is set to a range of 120° C. to 160° C. This setting range can be arbitrarily set depending on the capability of the fixing apparatus and the process speed, but in the present embodiment, the surface temperature of about 140°

C. of the pressure roller is adopted as a temperature at which a sufficient fixing property can be secured and also, when that temperature is exceeded, the sheet interval is set to a small value to thereby maintain high productivity.

While in the present embodiment, there has been shown an example in which the sheet interval is adjusted by the number of sheet interval revolutions of the pressure roller in the fixing apparatus wherein the pressure roller 20 is provided with no heater, the sheet interval may be finely set as in the first embodiment. Also, in the first embodiment, the hysteresis control shown in the second embodiment is effected, whereby it becomes possible to effect the more stable control of the surface temperature of the pressure roller.

(Third Embodiment)

Figure 8:
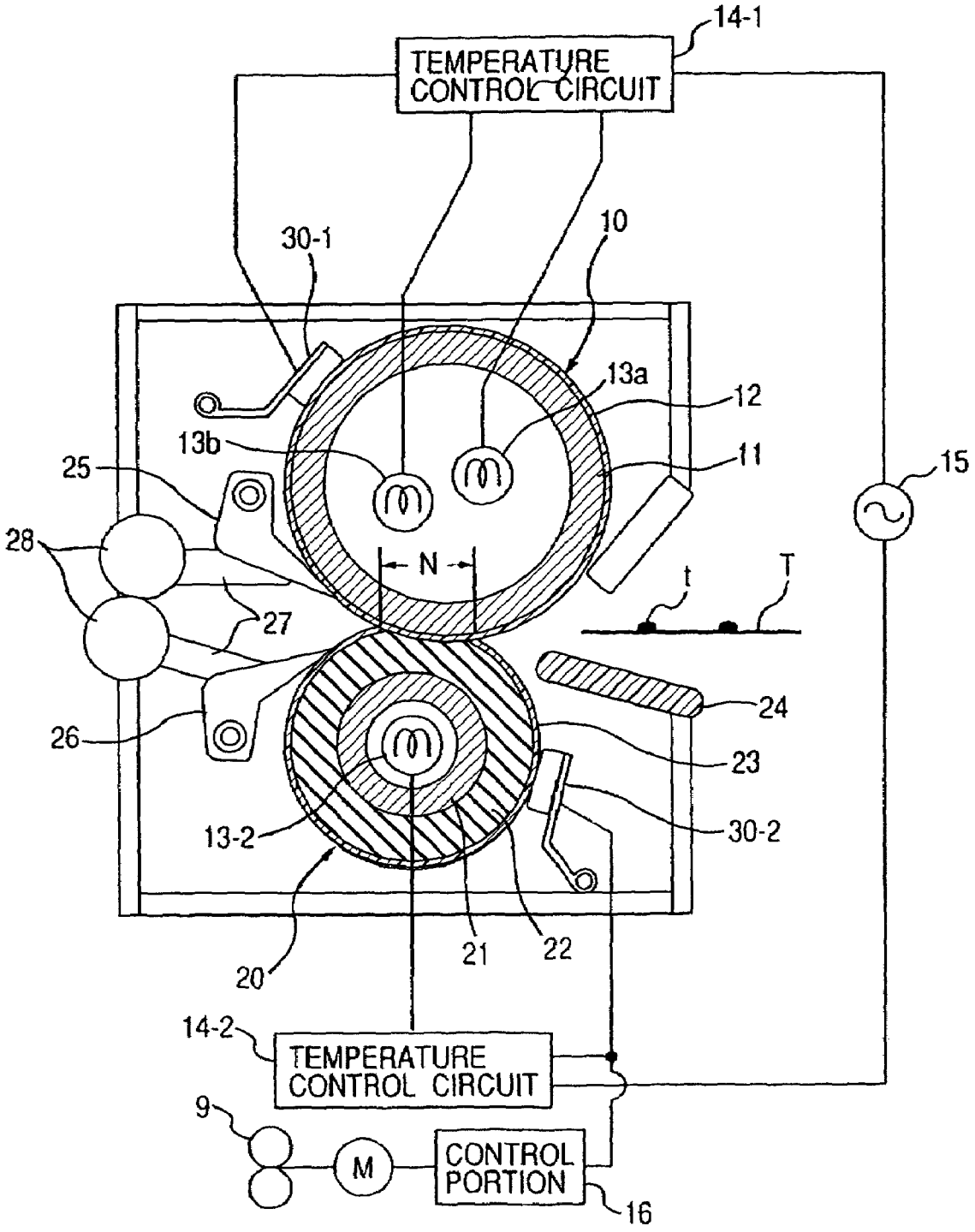
FIG. 8 is a cross-sectional view schematically showing the construction of a fixing apparatus according to a third embodiment of the present invention.
Figure 9:
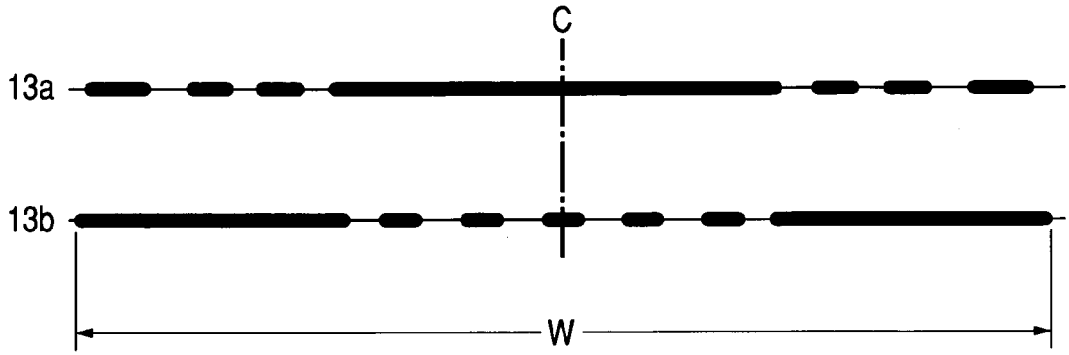
FIG. 9 shows the segment arrangement of the heater of the fixing apparatus according to the third embodiment.
Figure 10:
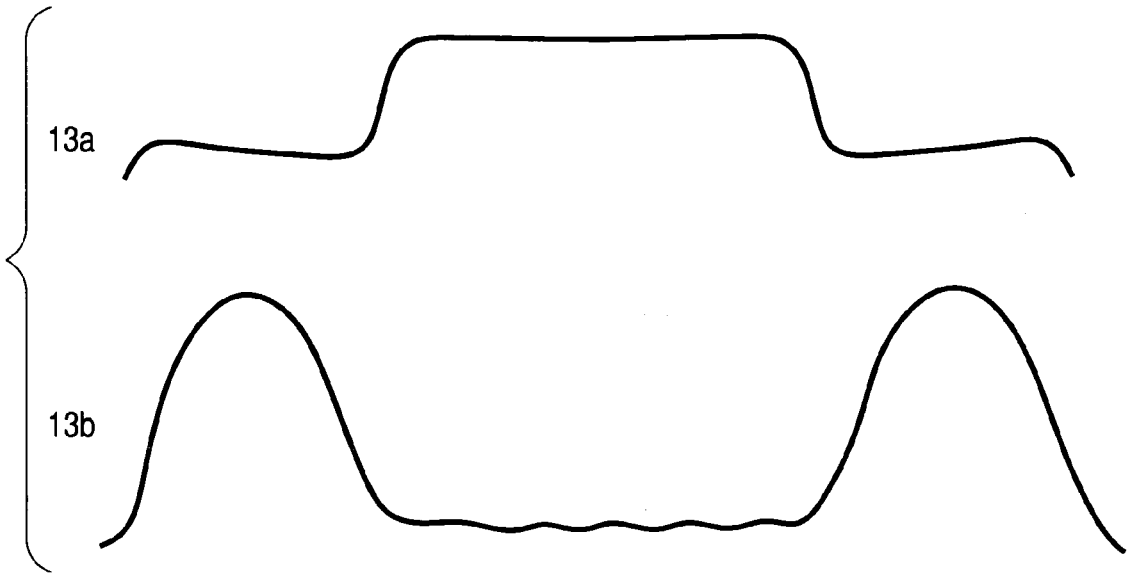
FIG. 10 shows the light distribution of the heater shown in FIG. 9.

FIG. 8 is a cross-sectional view schematically showing the construction of a fixing apparatus as a heating apparatus (fixing apparatus) according to a third embodiment of the present invention. This fixing apparatus is an example of the center reference in which transferring materials having the A3 (297 mm) width as the maximum sheet supply size are conveyed with the center of sheet supply of the apparatus as the reference, and uses the same members as those in the first embodiment except the heater of the fixing roller 10 and therefore, those members need not be described. As shown in FIG. 8, a plurality of (in the shown example, two) heaters 13*a* and 13*b* are provided in the interior of the fixing roller 10. As the heater 13*a*, use is made of one which produces an output of 700 W when 100 V is inputted, and as the heater 13*b*, use is made of one which produces an output of 300 W when 100 V is inputted, and as the heater 13-2, use is made of one which produces an output of 300 W when 100 V is inputted. The segment arrangements of the heaters 13*a* and 13*b* are shown in FIG. 9, and the light distributions of these heaters are shown in FIG. 10. As shown in FIG. 9, each of the heaters 13*a* and 13*b* has a distribution symmetrical with respect to the sheet supply reference C, and at the sheet supply width W, as shown in FIG. 10, use is made of two heaters, i.e., the heater 13*a* preponderantly having a light distribution at the central portion thereof, and the heater 13*b* preponderantly having light distributions at the end portions thereof. By combining these two heaters together, it is possible to secure a high printing speed for various paper sizes #. This is constructed with a view of preventing the temperature rise of a non-sheet supply region when sheets of different sizes such as A3 to A5 are printed, and realizing a high specification for sheets of all sizes.

So, when the temperature control of the fixing roller is to be effected, the heater 13*b* has its turned-on time determined in accordance with duty ratios shown in Table 3 below. As a heater driving method, a method proposed in Japanese Patent Application Laid-Open No. 7-334031 is adopted and therefore, description need not be made of it.

TABLE 3

| Paper Width | Turn-on Ratio (13a:13b) |
|---|---|
| A3, A4 landscape | 5:4 |
| LDR, LTR widthwise | 5:3 |
| B4 | 5:1 |
| A4 portrait, LEGAL, B5 or smaller | 5:0 |

In the present embodiment, the heater 13-2 of the pressure roller 20 and the heater 13*b* of the fixing roller 10 are of the same output and therefore, the heater 13*b* and the heater 13-2 can be driven by one and the same electric power supply. That is, the heater 13*b* is driven on the basis of the turn-on duty of Table 3 and therefore, it is possible to turn on the heater 13-2 of the pressure roller when the heater 13*b* is turned off. Consequently, again in the fixing apparatus in which the fixing roller 10 is provided with a plurality of heaters, sheet interval control can be effected as in the first embodiment.

Also, the smaller becomes the paper size, the lower becomes the turn-on duty of the heater 13*b* of the fixing roller 10, and electric power is portioned out to the heater 13-2 of the pressure roller 20 and therefore, it becomes easy to set the surface temperature of the pressure roller at a high level. Therefore, in the control wherein the sheet interval is adjusted with the surface temperature of the pressure roller 20 as the reference, if the surface temperature of the pressure roller is high, it becomes possible to control the sheet interval to a shorter length.

Consequently, in the fixing apparatus wherein as in the present embodiment, the fixing roller 10 is provided with a plurality of heaters 13*a* and 13*b* differing in heat generating distribution from each other, the sheet interval is made adjustable with the temperature of the pressure roller 20 as the reference, whereby it is possible to realize the highest possible throughput while sufficiently securing the fixing property of the thick paper and the rough paper for sheets of all sizes.

By the above-described construction, even in a case where electric power consumption exceeding the amount of supplied heat of the heater comes to be required, such as a case where paper of basis weight greater than usual is continuously printed during printing, or a case where continuous printing is effected under a low-temperature environment, it becomes possible to sufficiently use the supplied electric power of the heaters, and realize a maximum printing speed under a given environment, without extremely reducing the printing speed.

According to the fixing apparatus according to each of the above-described embodiments, when the thick paper or the rough paper is to be printed, unlike the existing thick paper mode or the rough paper mode, the sheet interval can be adjusted with the surface temperature of the pressure roller as the reference to thereby maintain the surface temperature of the pressure roller within a predetermined range and therefore, it is possible to secure a stable fixing property. Also, for an increase in the basis weight of paper or an increase in consumed electric power under a low-temperature environment, a predetermined amount of heat can be supplied to the paper by the sheet interval being adjusted and therefore, there can be provided a fixing apparatus which is stable in curling, stacking performance, etc. and gives priority to the print quality.

(Others)

The heating apparatus of the present invention is not restricted as the image heating and fixing apparatuses shown in the embodiments, but can be used as an image heating apparatus for heating a recording material bearing an image thereon to thereby improve surface properties such as gloss, etc., an image heating apparatus for tentatively fixing an image, and means and an apparatus for heating and treating a material to be heated, such as a heating and drying apparatus for a material to be heated and a heating laminate apparatus.

While various examples and embodiments of the present invention have been shown and described above, those skilled in the art could understand that the gist and scope of the present invention are not restricted to particular description and figures in the present specification, but extend to various modifications and changes set forth in the appended claims.

What is claimed is:

1. An image forming apparatus having a fixing apparatus for nipping a recording material bearing an unfixed toner image on a surface thereof by a nip portion between a fixing member and a pressure member and fixing the unfixed toner image on the surface of the recording material, comprising:

a heating member provided in the fixing member and for heating the fixing member;

a first temperature detecting element for detecting a temperature of said fixing member;

an electric power controller for controlling electric power supplied to said heating member in conformity with the temperature of said fixing member detected by said first temperature detecting element; and an interval controller for controlling a conveyance interval of the recording materials when image forming on a plurality of recording materials is to be continuously effected, wherein although no heating member is provided in said pressure member, a second temperature detecting element for detecting a temperature of said pressure member is provided, and the conveyance interval of the recording materials is variably controlled based on the detected temperature of said pressure member by said second temperature detecting element.

* * * * *

UNITED STATES PATENT AND TRADEMARK OFFICE

CERTIFICATE OF CORRECTION

PATENT NO. : 7,130,553 B2
APPLICATION NO. : 10/740544
DATED : October 31, 2006
INVENTOR(S) : Hiroaki Sakai It is certified that error appears in the above-identified patent and that said Letters Patent is hereby corrected as shown below:

ON THE TITLE PAGE, AT ITEM (56), RC:
Foreign Patent Documents:

"JP 2002229381 8/2002" should read --JP 2002-229381 8/2002--;
"JP 11052781 2/1999" should read --JP 11-052781 2/1999--;
"JP 09237013 9/1997" should read --JP 9-237013 9/1997--; and
"JP 8220929 8/1996" should read --JP 8-220929 8/1996--.

COLUMN 2:
Line 7, "as s" should read --as a--.
Line 40, "e.g." should read --e.g.,--.
Line 46, "the" (second occurrence) should read --to--.

COLUMN 9:
Line 38, "thickness" should read --thickness of--.
Line 50, "(image" should read --image--.

COLUMN 11:
Line 44, "sizes #." should read --sizes. --.

Signed and Sealed this

Tenth Day of April, 2007

JON W. DUDAS
*Director of the United States Patent and Trademark Office*